United States Patent [19]

Cohan

[11] 3,977,318

[45] Aug. 31, 1976

[54] MACHINE FOR SIMULTANEOUS TWO IMAGE FLEXOGRAPHIC PRINTING

[76] Inventor: Alvin M. Cohan, c/o American Production Machine Co., 3333 Park Ave., Union City, N.J. 07087

[22] Filed: Aug. 14, 1974

[21] Appl. No.: 497,423

[52] U.S. Cl. ..... 101/38 A; 101/181

[51] Int. Cl.[2] ..... B41F 17/28

[58] Field of Search ..... 101/38 A, 38 R, 40, 101/39, 36, 37, 35, 181

[56] References Cited

UNITED STATES PATENTS

| | | | |
|---|---|---|---|
| 2,624,274 | 1/1953 | Harvey | 101/38 A |
| 3,143,061 | 8/1964 | Excell | 101/38 R |
| 3,195,451 | 7/1965 | Hovekamp et al. | 101/38 R |
| 3,218,969 | 11/1965 | Nagel | 101/181 |
| 3,272,118 | 9/1966 | Ackley | 101/37 |
| 3,388,686 | 6/1968 | Cohan | 101/40 X |
| 3,398,678 | 8/1968 | Usko | 101/38 R |
| 3,411,439 | 11/1968 | Moes et al. | 101/38 R |
| 3,613,571 | 10/1971 | Russell et al. | 101/40 |
| 3,685,441 | 8/1972 | Aebersold et al. | 101/38 A |
| 3,735,697 | 5/1973 | Provan | 101/37 |
| 3,742,843 | 7/1973 | Gulikers | 101/41 |
| 3,789,754 | 2/1974 | Shofner et al. | 101/363 |

FOREIGN PATENTS OR APPLICATIONS

| | | | |
|---|---|---|---|
| 1,183,782 | 3/1970 | United Kingdom | 101/40 |

*Primary Examiner*—Edgar S. Burr
*Assistant Examiner*—William Pieprz
*Attorney, Agent, or Firm*—Brooks Haidt Haffner & Delahunty

[57] ABSTRACT

A two-color or two image flexographic printing apparatus is provided for post-printing non-planar articles, such as cups, by applying the ink to the article utilizing a pair of impression rolls which contact the article on diametrically opposite sides of the outer surface simultaneously as the article is rotated in printing contact with each of the impression rolls.

8 Claims, 5 Drawing Figures

MACHINE FOR SIMULTANEOUS TWO IMAGE FLEXOGRAPHIC PRINTING

BACKGROUND OF THE INVENTION

While machines are available today for printing volatile ink on articles, such as drinking cups, the cost of the machines and the limitations on their production rates do not respond to the very low cost increment practically available from the complete cost of the finished cup. Yet, the quality of dual color printing on cups is most important to the market and therefore, efforts have been made to utilize the fast drying volatile inks available today. An example of the efforts made is found in U.S. Pat. No. 3,645,201 to Jackson wherein a single color or indicia is printed at several printing stations.

The simultaneous printing of two colors on two cups at a time will be seen by the following and the drawings wherein.

Figure 1:
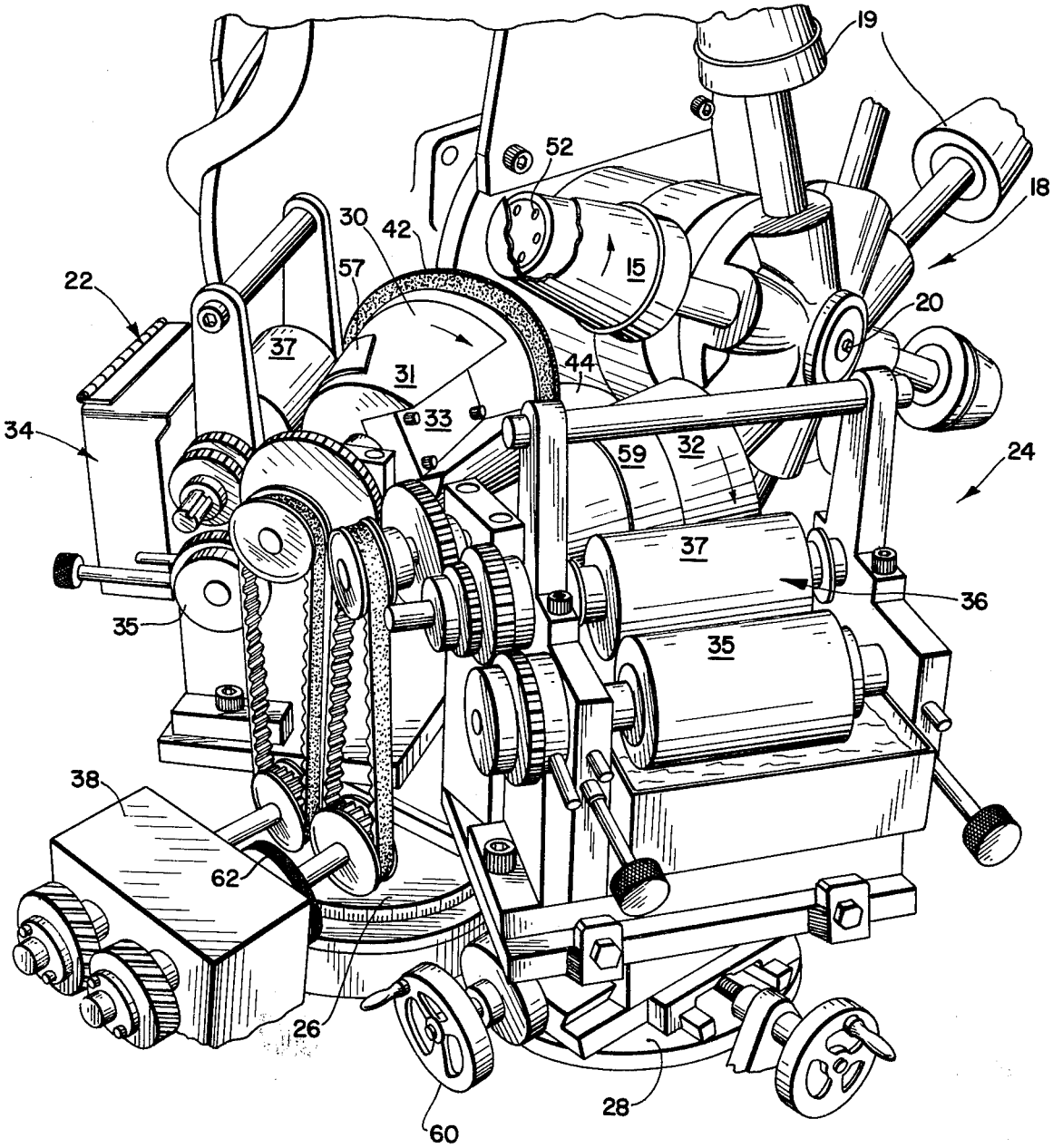
FIG. 1 is a perspective front view of the right print device.
Figure 2:
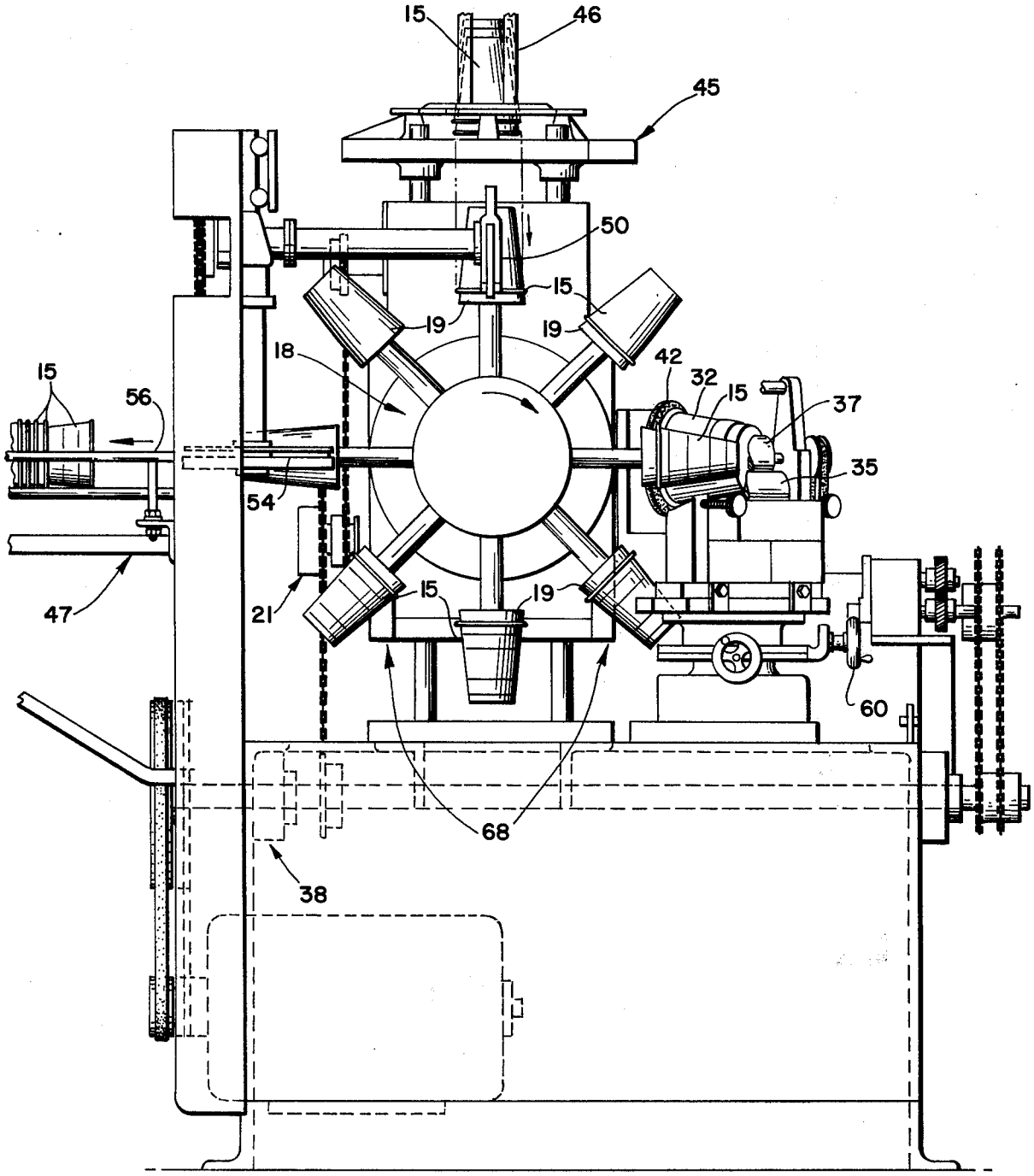
FIG. 2 is is a side elevation taken from the left of FIG. 3.
Figure 3:
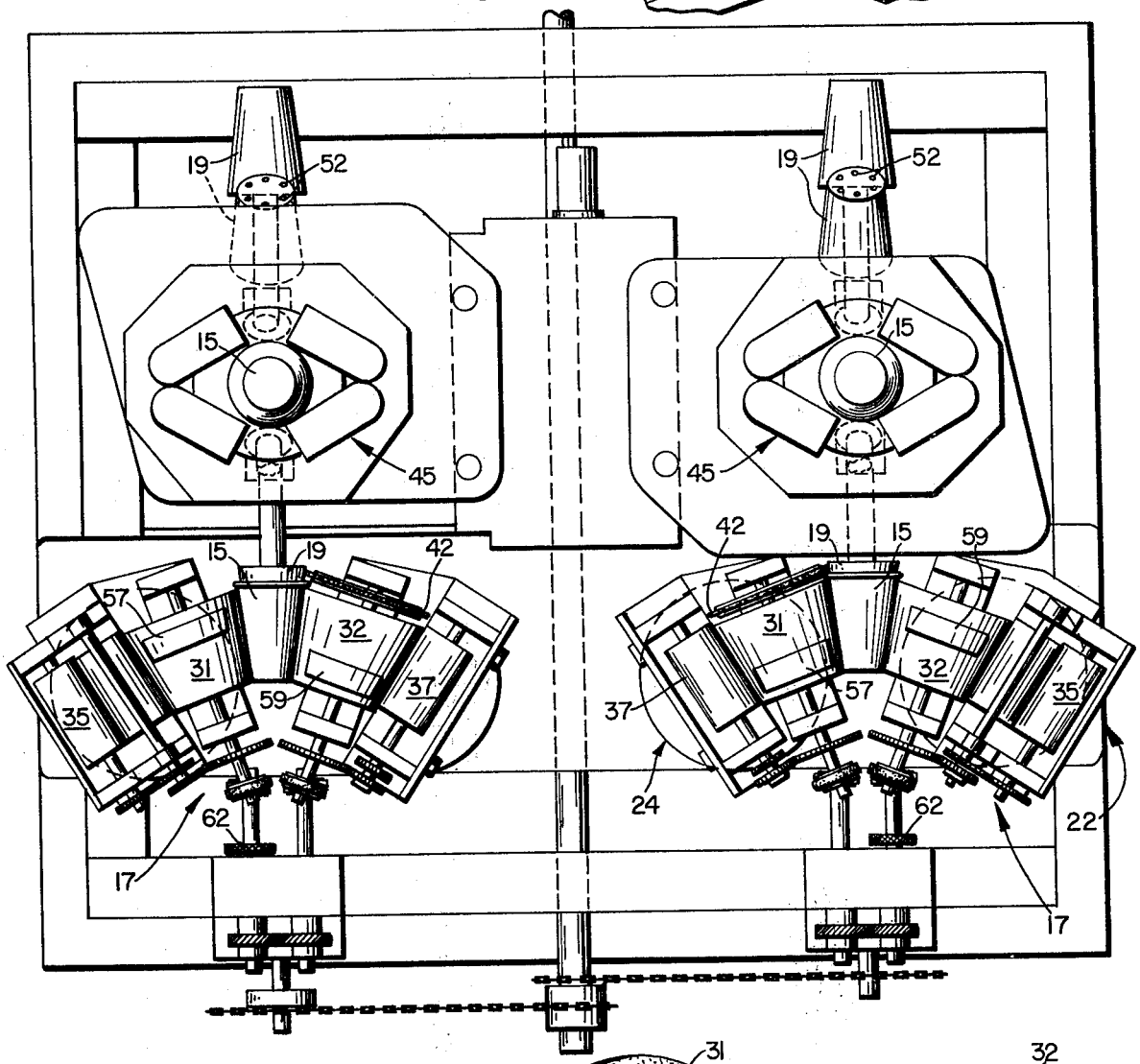
FIG. 3 is a top view of the dual printing device machine.

FIGS. 1–3 show a machine arranged to print two indicia, such as colors, printing, designs, etc., on two cups at a time. The two cups shown are tapered or frustroconical articles 16, 16; such articles may be cones or cylinders. This machine has a frame 15 with two mirror image printing devices 14, 14 each having two mirror image printing stations 17, 17 to which the two cups to be printed are delivered by their respective turrets 18, 18. A synchronized system drives the devices 14, 14.

Referring to one device 14 for purposes of description, it will be seen that the turret 18 is rotatably mounted on frame 15 and has eight spoke-like cup supporting mandrels 19 mounted thereon equiangularly on axes radially extending from the rotational axis of the turret 18, that is, the turret shaft 20.

Indexing means 21 of a suitable standard design is connected to the turret 18 to rotate the turret intermittently so as to index each mandrel 19 successively to its printing station 17.

Two printing heads 22, 24 are mounted on standard adjustment tables 26, 28 respectively, which are adjustably mounted on the frame 15 to provide for setting the heads for cylindrical or tapered printing. Each head 22, 24 has impression rolls, i.e., printing rolls 30, 32 (frustroconical as shown, or cylindrical if desired,) rotatably mounted with their axes in a common plane, preferably a substantially horizontal plane. The axis of the mandrel 19 when in the printing station 17 being in the same common plane so that dual line contact printing 180 degrees apart in the common plane can be accomplished.

Control drive means 38, 38 (front and back) is operably connected to and continuously drives, in predetermined synchronism, the turret indexing means 21, and rotates the impression rolls 30, 32 of both printing stations 17, 17. Also, the inking means 34, 36, cup loading station 45 and cup discharge station 47 are similarly driven in said synchronization.

Mandrel rotating means 42 is provided and, in the embodiment shown, the mandrel 19 is accelerated to the rotational speed of the impression rolls 30, 32 by the friction drive ring 42 extending from the inner end of the impression roll 30 which frictionally engages the inner base surface of the mandrel 19 when the mandrel dwells in the printing station 17. The axis of the drive ring 42 lies in the same common plane as the axis of the mandrel 19 when in the printing station 17.

Impression rolls 30, 32 are set in predetermined spaced relation in accordance with the article's size to define a passage 44 through the printing station 17 to which the mandrel mounted article 16 is delivered, dwells and exits upon the intermittent rotation of the turret 18.

Each impression roll 30, 32 has a printing portion 31 and a non-printing portion 33, the non-printing portion being of a size lengthwise and circumferentially which, through synchronization, enables the entrance and exit of a mandrel mounted cup without contact with the printing portion 31. The non-printing portion 33 is of a size which enables the acceleration of the mandrel to the r.p.m. speed of the two diametrically opposed impression rolls 30, 32. Other means may be provided for this required rotation of the article; however, the unique and structurally sound and uncomplicated direct frictional drive is believed most satisfactory.

Inking means 34 and 36 are provided for applying a volatile color ink to each of the rolls 30, 32 respectively. In the embodiment shown, the two inking cylinders 35, 37 of each inking means 34, 36 are also driven in synchronization with the turret 18 and impression rolls 30, 32.

The supply arrangement and discharge arrangement for the cups may be of various designs. Hollow cups 16 are nested upside-down and vertically in supply hoppers 46 at the loading station 45 from which single cups 16 are sequentially selected by a worm gear (not shown) and drawn downwardly by feed assist belt means 50 into a close telescoped position on the substantially vertically oriented mandrel 19 at the top loading station 45. Vacuum is then applied through holes 52 in the outer end of the frustroconical mandrel positively to hold the cup on the mandrel until sixth indexed to the discharge station 47 where the vacuum is released, a discharge belt means 54 breaks the face-to-face engagement of the cup with the mandrel by moving the cup substantially horizontally toward a storage hopper 56, and then a compressed air blow through mandrel holes 52 completes the discharge and nesting delivery of the printed article into the storage hopper 56.

The supply system and discharge system described above are synchronized by the control drive means 38 in a standard manner to accomplish the operations required.

Adjustment of the printing head 22 can be accomplished axially and angularly in a vernier-type manner to align accurately the two indicia 57, 59 of the two printing heads. Axial alignment involves the movement of the printing head 22, 24 forward and backward by the rotation of hand wheel 60 which causes the frustroconical surfaces of the impression rolls 30, 32 to move parallel to the frustroconical surfaces of the mandrel 19 and the cup tightly telescoped thereon. Angular or circumferential registration of indicia alignment involves the rotation of one of the impression rolls 30, the inner one as shown, by releasing knurled lock nut 62 (FIG. 3), and then rotating its impression roll 30 until precise registration of indicia is attained.

Operation involves the placement of a cup 16 on the mandrel 19 at a loading station 45 by a selecting worm and feed assist belt means 50, the cup then being held on the mandrel 19 by the vacuum. In U.S. Pat. No. 3,195,451 of 1965, a worm is disclosed at col. 2, line 38. The mandrel 19 then indexes forwardly and downwardly twice to the printing station 17 where the two impression rolls 30, 32 apply registered indicia on axial print lines 180° apart. The mandrel 19 then indexes downwardly and rearwardly four times through the drying station 66 to the discharge station 47 where the discharge belt means 54 initially dislodge the cup from a tight fit with the mandrel to prevent damage to the cup followed by a compressed air blow into nested relation with a stack of printed cups in the storage hopper 56. The mandrel is then indexed upwardly and forwardly two times to return to the loading station 45 for reloading.

Figure 4:
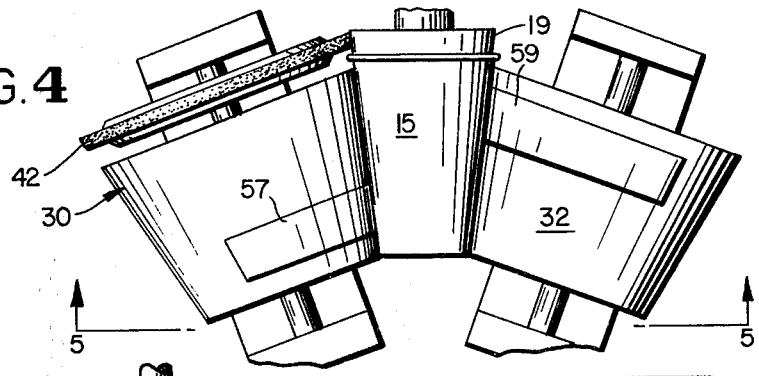
FIG. 4 is a top view of the right hand printing arrangement.
Figure 5:
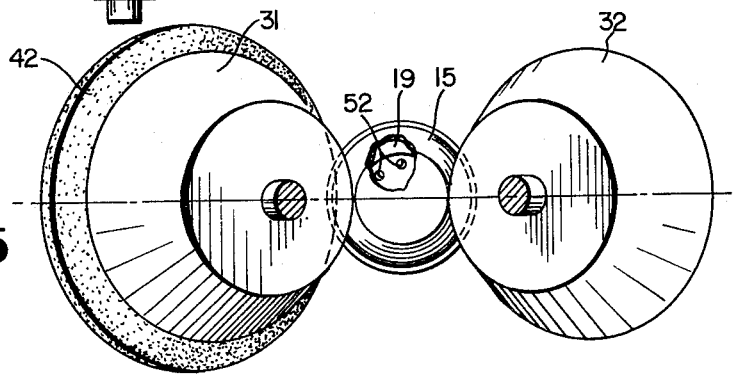
FIG. 5 is a front view of FIG. 4.

FIGS. 4 and 5 show the common horizontal axes and the cup lip and the drive ring 42.

Referring to the printing arrangement, more specifically, it involves a printing plate on which rubber "type" is mounted, the plate being conical or cylindrical. Ink is applied by a cylindrical "anilox" roll which is a stainless steel roll having small engraved markings over its entire surface. In the particular instance, these are pyramid in shape. Volatile ink is applied to the anilox roll by a rubber inking roll, also a cylinder, which is immersed at its lower portion in the ink pot and rolls against the anilox roll. The plate, anilox roll and inking roll all have the same peripheral rate of speed through the common synchronized drive. The rubber inking roll functions as the doctor and is set off to one side of the anilox roll where the rotation brings the surfaces of the rolls together beneath the axis of the anilox roll. On the other side, the inking roll is located beneath the anilox roll in order to permit drippage from the line of contact back into the pot.

Drying of the volatile ink takes place during passage through the three dwell positions on movement downward and the upward to the discharge station 47, such movement taking place in the drying station 68 which may be housed and equipped with an evacuating system to remove solvent and speed drying.

As shown, the turret is indexed in 45 degree increments, this being suitably accomplished through a barrel cam indexing movement. A suitable impression roll 30, 32 design is seen in FIG. 1 where about 240° can be used as the printing portion 31 and 120° can be used for entry, driving and exit of the mandrel, the cut-out of roll 30 providing this capability.

I claim:

1. A machine for simultaneously applying two registered images to the frustoconical or cylindrical outer wall surface of a hollow article comprising a frame;

two printing heads mounted on said frame, each said printing head having a printing roll, said two printing rolls being rotatably mounted with their axes in a common plane and being in predetermined spaced relation in accordance with the article size to define a passage therebetween for a said article, and each said printing roll having a raised image forming printing portion and a non-printing portion, the non-printing portions of said printing rolls being of sizes which when confronting each other enable the entrance and exit of a said article between said printing rolls without contact therewith, the printing portions of said printing rolls being of a size which when rotated to confront each other contact said article simultaneously;

a turret rotatably mounted on said frame having article supporting mandrels rotatably mounted thereon equiangularly on axes radially extending from the rotational axis of said turret, said turret being positioned such that the article supporting mandrels carry said articles supported thereon between said printing rolls upon rotation of said turret through a printing station for each said article mounted thereon wherein upon rotation of said printing rolls the printing portions thereof contact the surface of said article;

indexing means operably connected to said turret to rotate said turret intermittently between dwell positions in which each said mandrel successively is positioned to hold a said article at said printing station;

control drive means operably connected to and continuously driving said turret indexing means and continuously rotating said printing rolls in synchronism thereby to accomplish printing of a said article by simultaneous contact of said printing portions of said printing rolls during the dwell position of a said mandrel mounted article at said printing station; and mandrel rotating means mounted for rotation on the same axis as one said printing rolls apart from said printing portion thereof to be rotated therewith to engage and rotate each mandrel while in the printing station at the same speed as said printing rolls.

2. A machine as defined in claim 1, and wherein two horizontally spaced turrets are mounted on the frame for rotation about a horizontal axis, each turret having its own two print-heads with its mandrel, while in the printing station, being rotated about an axis in a common horizontal plane with the axes of the impression rolls.

3. A machine as defined in claim 1, and wherein said mandrel rotating means includes a drive ring peripherally extending from said one printing roll.

4. A machine as defined in claim 3, and including means for relatively axially and angularly adjusting the printing heads and the printing rolls to insure registration of the two indicia on printing.

5. A machine for simultaneously applying two registered images to the frustoconical or cylindrical outer wall surface of a hollow article comprising a frame;

two printing heads mounted on said frame, each said printing head having a printing roll, said two printing rolls being rotatably mounted with their axes in a common plane and being in predetermined spaced relation in accordance with the article size to define a passage therebetween for a said article, and each said printing roll having a raised image forming printing portion and a non-printing portion, the non-printing portions of said printing rolls being of sizes which when confronting each other enable the entrance and exit of a said article between said printing rolls without contact therewith, and the printing portions of said printing rolls being of a size which when rotated to confront each other contact said article simultaneously;

a turret mounted on said frame for rotation about a horizontal axis having article supporting mandrels rotatably mounted thereon equi-angularly on axes radially extending from the rotational axis of said turret, said turret being positioned such that the article supporting mandrels carry said article supported thereon between said printing rolls upon rotation of said turret through a printing station for each said article mounted thereon wherein upon rotation of said printing rolls the printing portions thereof contact the surface of said article;

indexing means operably connected to said turret to rotate said turret intermittently between dwell positions in which each said mandrel successively is positioned to hold a said article successively from a top load station, down to a front printing station, down and up through a drying station, then to a back discharge station and up to the load station;

inking means for applying a volatile liquid ink to said printing rolls;

control drive means operably connected to and continuously driving said turret indexing means and continuously rotating said printing rolls in synchronism thereby to accomplish printing of a said article by simultaneous contact of said printing portions of said printing rolls during the dwell position of a said mandrel mounted article at said printing station; and mandrel rotating means mounted for rotation on the same axis as one said printing rolls apart from said printing portion thereof to be rotated therewith to engage and rotate each mandrel while in the printing station at the same speed as said printing rolls.

6. A machine as defined in claim 5, wherein said mandrel rotating means includes a drive ring peripherally extending from said one printing roll.

7. A machine as defined in claim 6, and wherein said printing portion is of a peripheral surface width and length to enable the entire peripheral surface of the cup to be printed during a single revolution of the printing roll.

8. A machine as defined in claim 5 and including means for relatively axially and angularly adjusting the printing heads and the printing rolls to insure registration of the two indicia on printing.

* * * * *